US010634322B1

(12) United States Patent
Hsu

(10) Patent No.: US 10,634,322 B1
(45) Date of Patent: Apr. 28, 2020

(54) QUICKLY ASSEMBLED CEILING LIGHT FIXTURE

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: DONG GUAN JIA SHENG LIGHTING TECHNOLOGY CO., LTD. CHINA, Guang Dong (CN)

( * ) Notice: Subject to any disclaimer, the term of this patent is extended or adjusted under 35 U.S.C. 154(b) by 0 days.

(21) Appl. No.: 16/502,072

(22) Filed: Jul. 3, 2019

(51) Int. Cl.

| | |
|---|---|
| ***F21V 21/00*** | (2006.01) |
| ***F21V 21/04*** | (2006.01) |
| ***F21S 8/04*** | (2006.01) |
| ***F21V 17/16*** | (2006.01) |
| ***F21V 17/12*** | (2006.01) |
| ***F21V 19/00*** | (2006.01) |

(52) U.S. Cl.
CPC ..... *F21V 21/047* (2013.01); *F21S 8/04* (2013.01); *F21V 17/12* (2013.01); *F21V 17/164* (2013.01); *F21V 19/0035* (2013.01)

(58) Field of Classification Search
CPC ..... F21V 21/047; F21V 17/02; F21V 17/164; F21V 19/0035; F21S 8/04
USPC ..... 362/147, 148, 150, 364, 365, 368, 404, 362/647, 649, 655
See application file for complete search history.

(56) References Cited

U.S. PATENT DOCUMENTS

| | | | | |
|---|---|---|---|---|
| 4,670,822 | A * | 6/1987 | Baker | F21S 41/196 362/652 |
| 4,922,388 | A * | 5/1990 | Freudenreich | F21S 41/196 362/519 |
| 5,186,535 | A * | 2/1993 | Yokoyama | F21S 41/196 362/649 |
| 5,272,605 | A * | 12/1993 | Johnstone | G08B 7/062 248/906 |
| 6,648,488 | B1 * | 11/2003 | Pearce | F04D 25/088 362/147 |
| 7,300,188 | B2 * | 11/2007 | Tseng | H01R 33/09 362/147 |
| 2004/0246708 | A1 * | 12/2004 | Wu | F21V 21/02 362/147 |

* cited by examiner

*Primary Examiner* — Laura K Tso
(74) *Attorney, Agent, or Firm* — Alan D. Kamrath; Mayer & Williams PC

(57) ABSTRACT

A ceiling light fixture includes an embedded box, a mounting board, a ceiling light assembly, and a locking member. The embedded box is inserted into a ceiling. The mounting board is mounted in the embedded box and is provided with two locking slots each including an introducing portion, and a retaining section. The locking member is mounted on the ceiling light assembly and includes two locking portions and a linking portion. Each of the locking portions is introduced into the introducing portion of one of the locking slots. When the locking member is rotated relative to the mounting board, each of the locking portions is moved in the one of the locking slots, and is locked in the retaining section of the one of the locking slots, such that the locking portions are locked by the mounting board.

8 Claims, 3 Drawing Sheets

QUICKLY ASSEMBLED CEILING LIGHT FIXTURE

BACKGROUND OF THE INVENTION

1. Field of the Invention

The present invention relates to a lighting device and, more particularly, to a ceiling fitting or a ceiling light fixture.

2. Description of the Related Art

A conventional ceiling fitting is mounted on the ceiling of a house room to provide an illuminating function. In general, the conventional ceiling fitting is affixed to the ceiling by a plurality of fasteners, such as screws or expansion bolts, during the assembling process. However, operations of the fasteners easily do damage to the construction of the ceiling. In addition, it is difficult to operate the fasteners to mount the conventional ceiling fitting to the ceiling, thereby causing inconvenience to the operator during assembly.

BRIEF SUMMARY OF THE INVENTION

The primary objective of the present invention is to provide a ceiling light fixture that has a simplified construction and is assembled and disassembled easily and quickly.

In accordance with the present invention, there is provided a ceiling light fixture comprising an embedded box, a mounting board, a ceiling light assembly, and a locking member. The embedded box is inserted into a ceiling. The mounting board is mounted in the embedded box. The mounting board is provided with two locking slots which are arranged opposite to each other. Each of the two locking slots of the mounting board includes an introducing portion, and a retaining section connected to the introducing portion. The locking member is mounted on a top of the ceiling light assembly. The locking member includes two locking portions and a linking portion located between the two locking portions. The linking portion of the locking member is arranged at a bottom end of each of the two locking portions. The two locking portions of the locking member are arranged horizontally opposite to each other. Each of the two locking portions of the locking member has an inverted V-shaped profile. When the locking member is moved toward the mounting board, each of the two locking portions of the locking member is introduced into the introducing portion of one of the two locking slots of the mounting board, and when the locking member is rotated relative to the mounting board, each of the two locking portions of the locking member is moved in the one of the two locking slots of the mounting board, and is moved into and locked in the retaining section of the one of the two locking slots of the mounting board, such that the two locking portions of the locking member are locked by the mounting board. The retaining section of each of the two locking slots of the mounting board has a tapered shape and has a dimension that is reduced gradually in a clockwise direction or in a counterclockwise direction. The introducing portion of each of the two locking slots of the mounting board has an outermost sidewall, and each of the two locking portions of the locking member has an outer surface. A distance between the outermost sidewalls of the two introducing portions is greater than or equal to a maximum distance between the outer surfaces of the two locking portions, and a distance between the two retaining sections is smaller than the maximum distance between the outer surfaces of the two locking portions.

According to the primary advantage of the present invention, the locking member is locked onto the mounting board, to attach the ceiling light assembly to the mounting board, such that the ceiling will not be damaged during installation of the ceiling light assembly.

According to another advantage of the present invention, the locking member is mounted on the mounting board by rotation of the locking member or the ceiling light assembly, such that the ceiling light assembly is mounted on the ceiling easily and quickly, thereby decreasing the working time of installation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
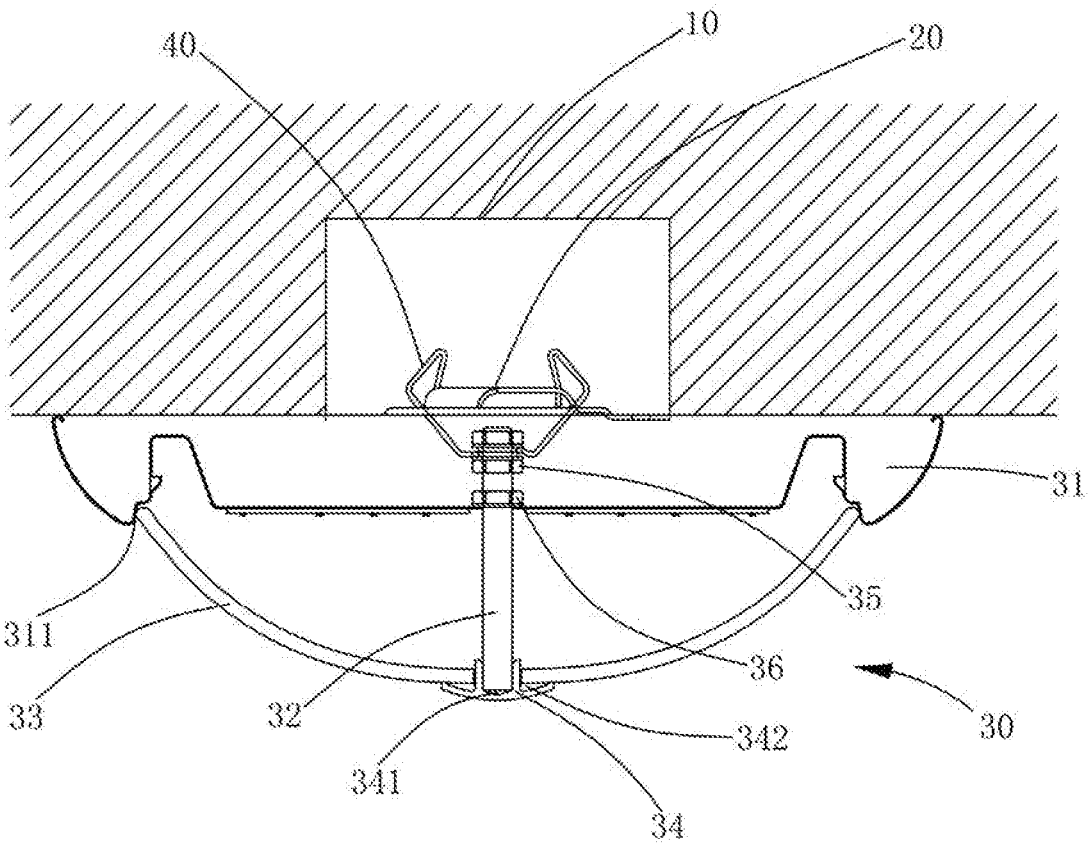
FIG. 1 is a cross-sectional view of a ceiling light fixture in accordance with the preferred embodiment of the present invention.
Figure 2:
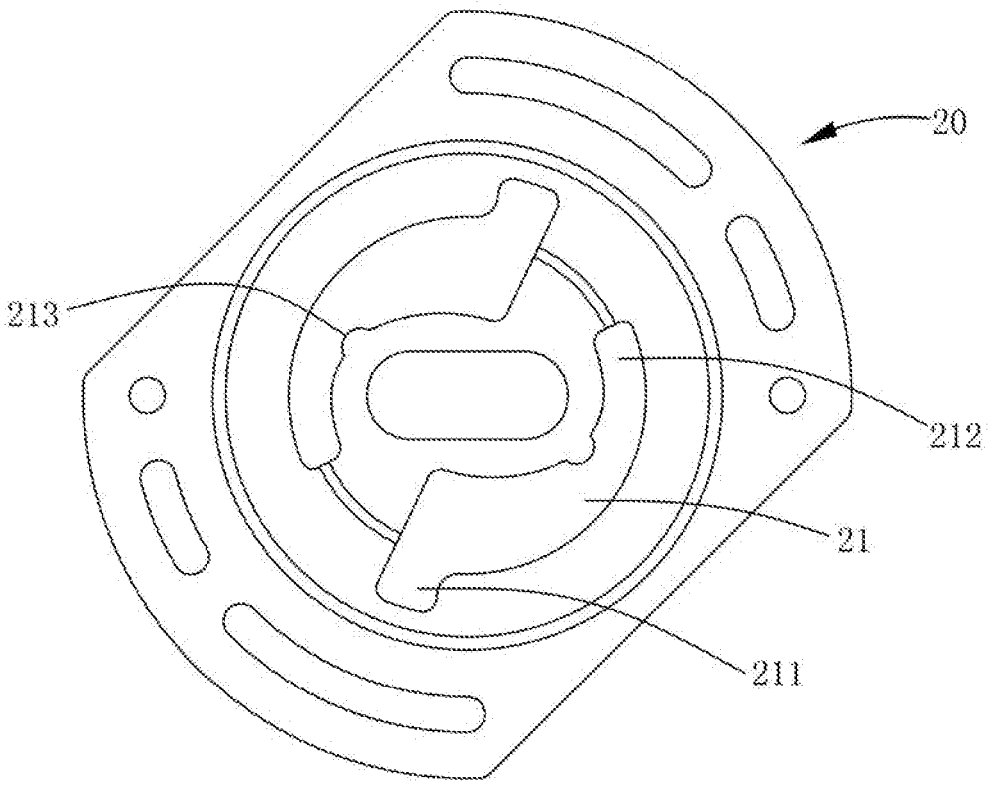
FIG. 2 is a planar view of a mounting board of the ceiling light fixture in accordance with the preferred embodiment of the present invention.
Figure 3:
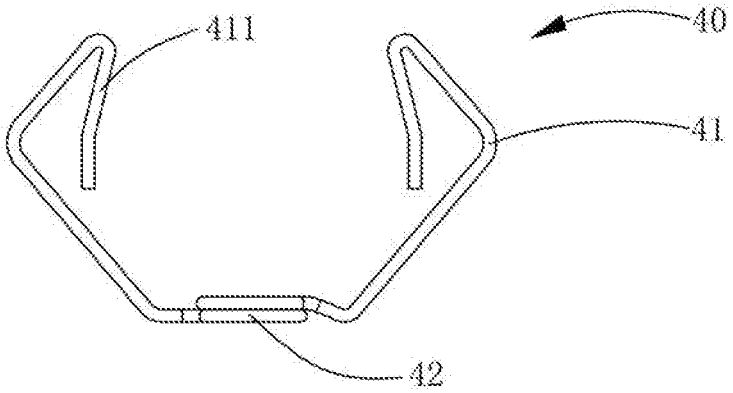
FIG. 3 is a planar view of a locking member of the ceiling light fixture in accordance with the preferred embodiment of the present invention.

Referring to FIGS. 1-3, a ceiling light fixture in accordance with the preferred embodiment of the present invention comprises an embedded (or implanted) box 10, a mounting board 20, a ceiling light assembly 30, and a locking (or snap-fit) member 40.

The embedded box 10 is inserted into a ceiling. The mounting board 20 is mounted in the embedded box 10. The mounting board 20 is provided with two locking slots 21 which are arranged opposite to each other. Each of the two locking slots 21 of the mounting board 20 includes an introducing portion (or entrance) 211, and a retaining (or restricting or fixing) section 212 connected to the introducing portion 211. The locking member 40 is mounted on a middle of a top of the ceiling light assembly 30. The locking member 40 is made of elastic material and includes two locking portions 41 and a linking portion 42 located between the two locking portions 41. The linking portion 42 of the locking member 40 is arranged at a bottom end of each of the two locking portions 41. The two locking portions 41 of the locking member 40 are arranged horizontally opposite to each other. Each of the two locking portions 41 of the locking member 40 has an inverted V-shaped profile.

In operation, when the locking member 40 is moved toward the mounting board 20, each of the two locking portions 41 of the locking member 40 is introduced into the introducing portion 211 of one of the two locking slots 21 of the mounting board 20, and when the locking member 40 is rotated relative to the mounting board 20, each of the two locking portions 41 of the locking member 40 is moved in the one of the two locking slots 21 of the mounting board 20, and is moved into and locked in the retaining section 212 of the one of the two locking slots 21 of the mounting board 20, such that the two locking portions 41 of the locking member 40 are locked by the mounting board 20, to lock the locking member 40 onto the mounting board 20, and to attach and secure the ceiling light assembly 30 to the mounting board 20.

In the preferred embodiment of the present invention, the retaining section 212 of each of the two locking slots 21 of the mounting board 20 has a tapered shape and has a dimension (or size or width) that is reduced gradually in a clockwise direction or in a counterclockwise direction.

In the preferred embodiment of the present invention, the introducing portion 211 of each of the two locking slots 21 of the mounting board 20 has an outermost sidewall, and each of the two locking portions 41 of the locking member 40 has an outer surface. Thus, a distance between the outermost sidewalls of the two introducing portions 211 is greater than or equal to a maximum distance between the outer surfaces of the two locking portions 41, and a distance between the two retaining sections 212 is smaller than the maximum distance between the outer surfaces of the two locking portions 41.

In the preferred embodiment of the present invention, each of the two locking portions 41 of the locking member 40 has an upper end formed with a locking pole (or shank or leg) 411 extending downward, and has a lower end connected with the linking portion 42. Each of the two locking portions 41 of the locking member 40 and the locking pole 411 of each of the two locking portions 41 are locked in the retaining section 212 of the one of the two locking slots 21 of the mounting board 20, such that the ceiling light assembly 30 is mounted on the mounting board 20 solidly and steadily. The retaining section 212 of each of the two locking slots 21 of the mounting board 20 is provided with a projection 213 which is located between the retaining section 212 and the introducing portion 211. Thus, the projection 213 of each of the two locking slots 21 of the mounting board 20 stops and restricts each of the two locking portions 41 of the locking member 40, to prevent each of the two locking portions 41 of the locking member 40 from being returned into the introducing portion 211 of each of the two locking slots 21 of the mounting board 20 by a reverse rotation of the locking member 40, and to prevent the locking member 40 from being detached from the mounting board 20, so as to avoid detachment of the ceiling light assembly 30.

In the preferred embodiment of the present invention, the ceiling light assembly 30 includes a top disk (or plate or bracket or mount) 31, a connecting rod 32, a lampshade 33, and a fastener 34. The lampshade 33 of the ceiling light assembly 30 is mounted on a bottom of the top disk 31. The connecting rod 32 of the ceiling light assembly 30 extends through the lampshade 33 and the top disk 31. The connecting rod 32 of the ceiling light assembly 30 is connected with the linking portion 42 of the locking member 40. The fastener 34 of the ceiling light assembly 30 is mounted on the connecting rod 32 and located outside of the lampshade 33. Preferably, The connecting rod 32 of the ceiling light assembly 30 has an upper end connected with the linking portion 42 of the locking member 40 and has a lower end connected with the fastener 34.

In the preferred embodiment of the present invention, the top disk 31 of the ceiling light assembly 30 is provided with a circuit board, and at least one lighting member mounted on the circuit board. The bottom of the top disk 31 is provided with a through hole, and the connecting rod 32 of the ceiling light assembly 30 serially extends through the through hole of the top disk 31, and the linking portion 42 of the locking member 40, and is connected with the locking member 40.

In the preferred embodiment of the present invention, the ceiling light assembly 30 further includes a nut unit which includes two first nuts 35 and a second nut 36. Each of the two first nuts 35 has a dimension greater than that of the through hole of the top disk 31. The second nut 36 has a dimension greater than that of the through hole of the top disk 31.

In the preferred embodiment of the present invention, the connecting rod 32 of the ceiling light assembly 30 is a threaded rod formed with an external thread. The two first nuts 35 are screwed onto the connecting rod 32, and are arranged at two sides of the linking portion 42 of the locking member 40, with the linking portion 42 of the locking member 40 being located between the two first nuts 35, such that the connecting rod 32 of the ceiling light assembly 30 is connected with the locking member 40. The second nut 36 is screwed onto the connecting rod 32, and is arranged at an inner side of the through hole of the top disk 31.

In the preferred embodiment of the present invention, the fastener 34 of the ceiling light assembly 30 has an interior provided with a fastening recess 341 secured on the connecting rod 32. The fastener 34 of the ceiling light assembly 30 has two sides each provided with an extension, with a limit space 342 being defined between the fastener 34 and the extension. The top disk 31 of the ceiling light assembly 30 has two sides each provided with a cutout 311.

In the preferred embodiment of the present invention, the lampshade 33 of the ceiling light assembly 30 has a first end received in and abutting the cutout 311 of the top disk 31, and has a second end received in and abutting the limit space 342 of the fastener 34.

In the preferred embodiment of the present invention, the mounting board 20 is an eight-trigram or eight-diagram board.

In assembly, the connecting rod 32 of the ceiling light assembly 30 in turn extends through the through hole of the top disk 31, and the linking portion 42 of the locking member 40, and is connected with the locking member 40. The connecting rod 32 of the ceiling light assembly 30 and the locking member 40 are secured to the top disk 31 by the two first nuts 35. The fastener 34 of the ceiling light assembly 30 is mounted on the bottom of the connecting rod 32. The first end of the lampshade 33 of the ceiling light assembly 30 is received in and rests on the cutout 311 of the top disk 31, and the second end of the lampshade 33 of the ceiling light assembly 30 is received in and rests on the limit space 342 of the fastener 34, such that the lampshade 33 of the ceiling light assembly 30 is mounted on the top disk 31. The mounting board 20 is mounted in the embedded box 10 previously. Then, the locking member 40 is to be mounted on the mounting board 20. When the locking member 40 is moved toward the mounting board 20, each of the two locking portions 41 of the locking member 40 is introduced into the introducing portion 211 of one of the two locking slots 21 of the mounting board 20. When the locking member 40 is rotated relative to the mounting board 20, each of the two locking portions 41 of the locking member 40 is moved in the one of the two locking slots 21 of the mounting board 20, and is moved into and locked in the retaining section 212 of the one of the two locking slots 21 of the mounting board 20, such that the two locking portions 41 of the locking member 40 are locked by the mounting board 20, to lock the locking member 40 onto the mounting board 20, and to attach and secure the ceiling light assembly 30 to the mounting board 20. Thus, the ceiling light assembly 30 is mounted on the ceiling by locking of the locking member 40 and the mounting board 20.

Accordingly, the locking member 40 is locked onto the mounting board 20, to attach the ceiling light assembly 30 to the mounting board 20, such that the ceiling will not be damaged during installation of the ceiling light assembly 30. In addition, the locking member 40 is mounted on the mounting board 20 by rotation of the locking member 40 or the ceiling light assembly 30, such that the ceiling light assembly 30 is mounted on the ceiling easily and quickly, thereby decreasing the working time of installation. Further, the ceiling light fixture has a simplified construction, thereby decreasing of fabrication and production.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling light fixture comprising:

an embedded box, a mounting board, a ceiling light assembly, and a locking member;

wherein:

the embedded box is inserted into a ceiling;

the mounting board is mounted in the embedded box;

the mounting board is provided with two locking slots which are arranged opposite to each other;

each of the two locking slots of the mounting board includes an introducing portion, and a retaining section connected to the introducing portion;

the locking member is mounted on a top of the ceiling light assembly;

the locking member includes two locking portions and a linking portion located between the two locking portions;

the linking portion of the locking member is arranged at a bottom end of each of the two locking portions;

the two locking portions of the locking member are arranged horizontally opposite to each other;

each of the two locking portions of the locking member has an inverted V-shaped profile;

when the locking member is moved toward the mounting board, each of the two locking portions of the locking member is introduced into the introducing portion of one of the two locking slots of the mounting board;

when the locking member is rotated relative to the mounting board, each of the two locking portions of the locking member is moved in the one of the two locking slots of the mounting board, and is moved into and locked in the retaining section of the one of the two locking slots of the mounting board, such that the two locking portions of the locking member are locked by the mounting board;

the retaining section of each of the two locking slots of the mounting board has a tapered shape and has a dimension that is reduced gradually in a clockwise direction or in a counterclockwise direction;

the introducing portion of each of the two locking slots of the mounting board has an outermost sidewall, and each of the two locking portions of the locking member has an outer surface;

a distance between the outermost sidewalls of the two introducing portions is greater than or equal to a maximum distance between the outer surfaces of the two locking portions; and a distance between the two retaining sections is smaller than the maximum distance between the outer surfaces of the two locking portions.

2. The ceiling light fixture of claim 1, wherein:

each of the two locking portions of the locking member has an upper end formed with a locking pole extending downward;

each of the two locking portions of the locking member and the locking pole of each of the two locking portions are locked in the retaining section of the one of the two locking slots of the mounting board; and the retaining section of each of the two locking slots of the mounting board is provided with a projection.

3. The ceiling light fixture of claim 1, wherein:

the ceiling light assembly includes a top disk, a connecting rod, a lampshade, and a fastener;

the lampshade of the ceiling light assembly is mounted on a bottom of the top disk;

the connecting rod of the ceiling light assembly extends through the lampshade and the top disk;

the connecting rod of the ceiling light assembly is connected with the linking portion of the locking member; and the fastener of the ceiling light assembly is mounted on the connecting rod and located outside of the lampshade.

4. The ceiling light fixture of claim 3, wherein:

the top disk of the ceiling light assembly is provided with a circuit board, and at least one lighting member mounted on the circuit board;

the bottom of the top disk is provided with a through hole; and the connecting rod of the ceiling light assembly serially extends through the through hole of the top disk, and the linking portion of the locking member, and is connected with the locking member.

5. The ceiling light fixture of claim 4, wherein:

the ceiling light assembly further includes a nut unit which includes two first nuts and a second nut;

each of the two first nuts has a dimension greater than that of the through hole of the top disk; and the second nut has a dimension greater than that of the through hole of the top disk.

6. The ceiling light fixture of claim 5, wherein:

the connecting rod of the ceiling light assembly is a threaded rod formed with an external thread;

the two first nuts are screwed onto the connecting rod, and are arranged at two sides of the linking portion of the locking member; and the second nut is screwed onto the connecting rod, and is arranged at an inner side of the through hole of the top disk.

7. The ceiling light fixture of claim 5, wherein:

the fastener of the ceiling light assembly has an interior provided with a fastening recess secured on the connecting rod;

the fastener of the ceiling light assembly has two sides each provided with an extension, with a limit space being defined between the fastener and the extension; and the top disk of the ceiling light assembly has two sides each provided with a cutout.

8. The ceiling light fixture of claim 7, wherein the lampshade of the ceiling light assembly has a first end received in and abutting the cutout of the top disk, and has a second end received in and abutting the limit space of the fastener.

* * * * *